United States Patent [19]

Miyamoto et al.

[11] Patent Number: 4,877,702

[45] Date of Patent: Oct. 31, 1989

[54] ELECTROPHOTOGRAPHIC SENSITIVE MATERIAL

[75] Inventors: Eiichi Miyamoto, Osaka; Nariaki Mutou, Daito; Tooru Nakazawa, Osaka, all of Japan

[73] Assignee: Mita Industrial Co., Ltd., Osaka, Japan

[21] Appl. No.: 263,255

[22] Filed: Oct. 27, 1988

[30] Foreign Application Priority Data

| | | | |
|---|---|---|---|
| Oct. 30, 1987 | [JP] | Japan | 62-277158 |
| Oct. 30, 1987 | [JP] | Japan | 62-277159 |
| Oct. 30, 1987 | [JP] | Japan | 62-277161 |
| Oct. 30, 1987 | [JP] | Japan | 62-277162 |

[51] Int. Cl.[4] ..... G03G 5/09

[52] U.S. Cl. ..... 430/72; 430/59; 430/83

[58] Field of Search ..... 430/59, 72, 83

[56] References Cited

U.S. PATENT DOCUMENTS

| | | | |
|---|---|---|---|
| 4,273,846 | 6/1981 | Pai et al. | 430/59 |
| 4,556,622 | 12/1985 | Neumann et al. | 430/83 X |
| 4,587,189 | 5/1986 | Hor et al. | 430/59 |
| 4,714,666 | 12/1987 | Wiedemann et al. | 430/59 |
| 4,792,508 | 12/1988 | Kazmaier et al. | 430/59 |

FOREIGN PATENT DOCUMENTS

| | | | |
|---|---|---|---|
| 62-242951 | 10/1987 | Japan | 430/59 |

*Primary Examiner*—Roland E. Martin

*Attorney, Agent, or Firm*—Beveridge, DeGrandi & Weilacher

[57] ABSTRACT

There is disclosed an electrophotographic sensitive layer which is provided with a single-layer type sensitive layer containing a specific perylene type compound as an electric charge generating substance, a specific diamine derivative of the following general formula as an electric charge transferring substance, and a binding resin.

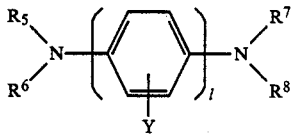

wherein $R^5$, $R^6$, $R^7$, and $R^8$ independently stand for either a group of the general formula:

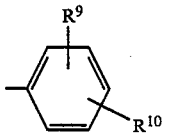

or a group of the general formula:

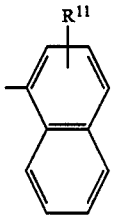

11 Claims, No Drawings

ELECTROPHOTOGRAPHIC SENSITIVE MATERIAL

FIELD OF THE INVENTION

This invention relates to an electrophotographic sensitive material useful advantageously in image forming devices such as a copying machine.

BACKGROUND OF THE INVENTION

In recent years, sensitive materials permitting ample freedom in the design of functions, particularly electrophotographic sensitive materials provided with a laminate type sensitive layer permitting division of functions by the use of an electric charge generating material adapted to generate electric charge on exposure to light and an electric charge transferring material to perform transfer of the generated electric charge, have been proposed as electrophotographic sensitive materials. In the specification of Japanese patent application Disclosure SHO 57(1982)-144,558 and Japanese patent application Disclosure SHO 61(1986)-62,038, there are disclosed electrphotographic sensitive materials which have superposed on an electroconductive substrate an electric charge generating layer containing as an electric charge generating substance a square phosphoric acid derivative and an electric charge transfer layer containing such a diamine derivative as 4,4'-bis[N-phenyl-N-(3-methylphenyl)amino]diphenyl. Other electrophotographic sensitive materials which are equivalent to those just mentioned, excepting cyanine type compounds, azo type compounds, and such perylene type compounds as N,N'-bis(2,4,6-trimethylphenyl)perylene-3,4,6,10-tetracarboxydiimide, N,N'-diphenylperylene-3,4,9,10-tetracarboxydiimide, and N,N'-dimethylperylene-3,4,9,10-tetracarboxydiimide are used instead as electric charge generating substances, are disclosed in the specifications of Japanese patent application Disclosure SHO 57(1982)-144,556, Japanese patent application Disclosure SHO 57(1982)-144,557, Japanese patent application Disclosure SHO 60(1985)-207,418, Japanese patent application Disclosure SHO 61(1986)-275,848, and Japanese Patent Application Disclosure SHO 61(1986)-132,955.

The sensitive materials having such a laminate type sensitive layer as described above are allowed to divide the function of electric charge generation and the function of transfer of generated electric charge by the use of the aforementioned electric charge generating layer and electric charge transfer layer and, therefore, have an advantage that they generally possess high sensitivity and permit ample freedom in the selection of raw materials therefor. Since the electric charge transferring substances used therein are generally positive hole transferring substances, however, these sensitive materials are positively charged with difficulty. As regards the positively charging toner for developing an electrostatic latent image formed on the sensitive material, the freedom in the selection of raw materials for the toner is restricted because this toner is obtained with great difficulty. An attempt at resorting to the negative charging by means of corona discharge proves to be undesirable from the standpoint of safety and hygiene because the corona discharge entails generation of ozone. Further, the use of the corona discharge inevitably requires the image forming device such as a copying machine to be provided with a passage to be used for expulsion of the generated ozone and, consequently, necessitates an increase in size of the device. The electric charge generating layer has a small thickness on the order of 1 to 2 $\mu$m and, therefore, must be formed with high accuracy. Since the sensitive material necessitates superposition of the electric charge generating layer and the electric charge transfer layer one on top of the other, this superposition inevitably increases the number of steps in the process for the production of the sensitive material, with the result that the operational efficiency will be impaired, the yield lowered, and the cost increased. Electrophotographic sensitive materials of the type provided with a single-layer type sensitive layer jointly containing an electric charge generating substance, an electric charge transferring substance, and a binding resin have been known to the art. The sensitive material of this type have an advantage that it can be charged positively and can prevent generation of ozone, enjoys ample freedom in the selection of raw materials for the toner, and permits the production thereof to be carried out with high efficiency. If, for furtherance of this advantage, the same electric charge generating substance and electric charge transferring substance as used in the laminate type sensitive layer mentioned above are used in the single-layer sensitive layer, the sensitive material using this single-layer type sensitive layer raises a problem that it exhibits no sufficient electrophotographic property. The single-layer type sensitive layer, unlike the laminate type sensitive layer, has both the electric charge generating substance and the electric charge transferring substance contained in a mixed state therein and does not easily permit division of the function of electric charge generation and the function of electric charge transfer. Thus, it suffers from restricted freedom in the selection of raw materials, low sensitivity, and high residual potential. Moreover, the electrophotographic properties of this sensitive material are heavily affected by the particular combination of an electric charge generating substance and an electric charge transferring substance. The aforementioned diamine derivative as an electric charge transferring substance exhibits meager dependence of drift mobility upon field intensity. The sensitive material furnished with the single-layer type sensitive layer containing the diamine derivative, therefore, is expected to exhibit small residual potential. When the single-layer type sensitive layer is produced by combining the diamine derivative with a varying perylene type compound as an electric charge generating substance, for example, the sensitive material furnished with this single-layer type sensitive layer raises a problem that it suffers from yet high residual potential and insufficient sensitivity and fails to exhibit sufficient electrophotograhic properties.

As regards the sensitive material using a single-layer type sensitive layer, the specification of Japanese patent application Disclosure SHO 56(1981)-143,438 discloses a sensitive material which is furnished with a single-layer type sensitive layer containing a polycyclic aromatic hydrocarbon as an electric charge generating substance and polyvinyl carbazole as an electric charge transferring substance.

In this sensitive material, however, since the positively charging property is not sufficient, the polyvinyl carbazole as the electric charge transferring substance exhibits low draft mobility. Since this sensitive material exhibits heavy dependency of the drift mobility upon the field intensity, it suffers from large residual potential and low sensitivity and exhibits no sufficient electrophotographic property.

For the purpose of offering an electrophotographic sensitive material which makes the most of the advantage of the single-layer type sensitive layer, excels in charging property and sensitivity, and enjoys low residual potential, the inventors formerly proposed a sensitive material furnished with a single-layer type sensitive layer produced by combining a perylene type compound like N,N'-bis(3,5-dimethylpheny)Perylene-3,4,9,10-tetracarboxydiimide with a hydrazone type compound like N-methyl-3-carbazolylaldenhyde-N,N-diphenyl hydrazone (Japanese patent application SHO 62(1987)-107,780).

The hydrazone type compound so used still suffers from heavy dependency of the draft mobility upon the field intensity, high residual potential, and insufficient sensitivity. While the hydrazone type compound has an advantage that it exhibits a lower degree of photoisomerization on exposure to light than 4-(N,N-diethylamino)benzaldehyde-N,N-diphenyl hydrazone, it raises a problem that it possess no sufficient photostability and suffers from gradual decrease of sensitivity and gradual increase of residual potential due to repeated use.

SUMMARY OF THE INVENTION

An object of this invention is to provide an electrophotographic sensitive material which excels in positively charging property and photostability.

Another object of this invention is to provide an electrophotographic sensitive material which exhibits high sensitivity and high surface potential and small residual potential in spite of the single-layer construction.

Yet another object of this invention is to provide an electrophotographic sensitive material which is easily produced in high yield and, therefore, is inexpensive.

In accordance with this invention, there is provided an electrophotographic sensitive material which is furnished with a single-layer type sensitive layer containing specific electric charge generating substance, electric charge transferring substance, and binding resin.

As the electric charge generating substance, a perylene type compound represented by the following general formula (1) is used:

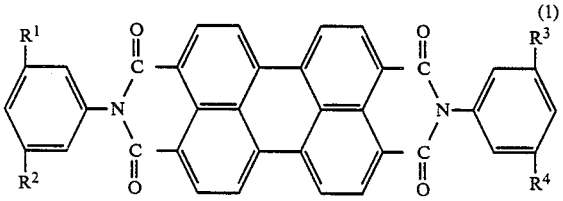

(1)

wherein $R^1$, $R^2$, $R^3$, and $R^4$ independently stand for an alkyl group of $C_1$ to $C_6$.

As the electric charge transferring substance, a diamine derivative represented by the following general formula (2) is used:

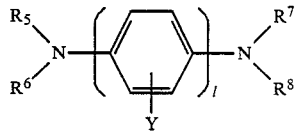

(2)

wherein $R^5$, $R^6$, $R^7$, and $R^8$ independently stand for a group of the following general formula:

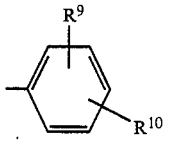

(3)

or

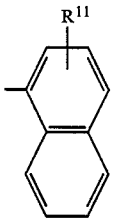

(4)

(wherein $R^9$, $R^{10}$, and $R^{11}$ independently stand for a member selected from the group consisting of a hydrogen atom, alkyl groups of $C_1$ to $C_6$, alkoxy groups of $C_1$ to $C_6$, and halogen atoms), providing that $R^5$, $R^6$, $R^7$, and $R^8$ each stand for either of the group (3) and the group (4) or $R^5$ and $R^7$ each stand for the group (3) and $R^6$ and $R^8$ each stand for the group (4); Y is selected from the group consisting of a hydrogen atom, alkyl groups to $C_1$ to $C_6$, alkoxy groups of $C_1$ to $C_6$, and halogen atoms; and l stands for an integer in the range of 1 to 3.

To be more specific, the diamine derivative represented by the general formula (2) mentioned above embrace the compounds represented by the following general formulas (2-*a*), (2-*b*), and (2-*c*).

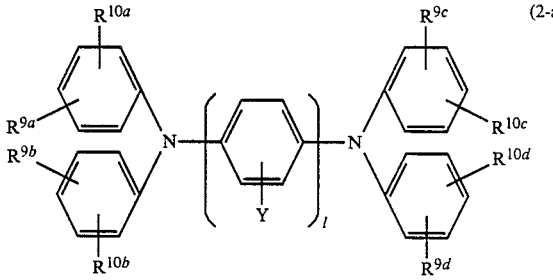

(2-a)

wherein $R^{9a}$ to $R^{9d}$ and $R^{10a}$ to $R^{10d}$ independently stand for a substituent selected from the group consisting of a hydrogen atom, alkyl groups of $C_1$ to $C_6$, alkoxy groups of $C_1$ to $C_6$, and halogen atoms, and Y and l have the same meanings as defined above,

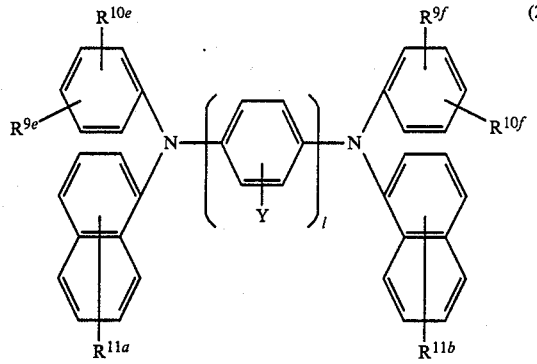

(2-b)

wherein $R^{9e}$, $R^{9f}$, $R^{10e}$, $R^{10f}$, $R^{11a}$, and $R^{11b}$ independently stand for one substituent selected from the group consisting of a hydrogen atom, alkyl groups of $C_1$ to $C_6$, alkoxy groups of $C_1$ to $C_6$, and halogen atoms, and Y and l have the same meanings as defined above, providing that at least either of $R^{9e}$ and $R^{10e}$ stands for a hydrogen atom and at least either of $R^{9f}$ and $R^{10f}$ stands for a hydrogen atom, and

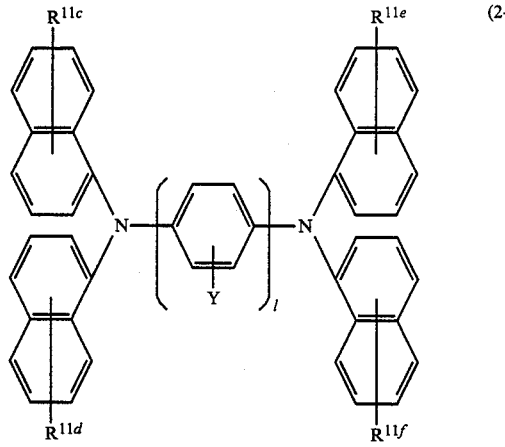

(2-c)

(wherein $R^{11c}$ and $R^{11f}$ independently stand for one substituent selected from the group consisting of a hydrogen atom, alkyl groups of $C_1$ to $C_6$, alkoxy groups of $C_1$ to $C_6$, and halogen atoms, and Y and l have the same meanings as defined above).

DETAILED DESCRIPTION OF THE INVENTION

The electrophotographic sensitive material of the present invention possesses a single-layer type sensitive layer and this sensitive layer contains as an electric charge generating substance a perylene type compound of the general formula (1), as electric charge transferring substance a diamine derivative of the general formula (2), and a binding resin.

As examples of the alkyl group in the general formula (1) and the general formula (2), such alkyl groups as methyl, ethyl, propyl, isopropyl, butyl isobutyl, tert-butyl, pentyl, and hexyl groups which have 1 to 6 carbon atoms, preferably 1 to 4 carbon atoms may be cited.

As examples of the alkoxy group in the general formula (2), such alkoxy groups as methoxy, ethoxy, propoxy, isopropoxy, butoxy, isobutoxy, tert-butoxy, pentyloxy, and hexyloxy groups which have 1 to 6 carbon atoms, preferably 1 to 4 carbon atoms may be cited.

The halogen atoms are fluorine, chlorine, bromine, and iodine atoms.

The substituents $R^9$, $R^{10}$, and $R^{11}$ and the substituent Y mentioned above may be attached to any desired positions of a phenyl ring or a naphthyl ring.

As examples of the perylene type compound represented by the general formula (I), there may be cited N,N'-di(3,5-dimethylphenyl)perylene-3,4,9,10-tetracarboxydiimide, N,N'-di(3-methyl-5-ethylphenyl)perylene-3,4,9,10-tetracarboxydiimide, N,N'-di(3,5-diethylphenyl)perylene-3,4,9,10-tetracarboxydiimide, N,N'-di(3,5-dipropylphenyl)perylene-3,4,9,10-tetracarboxydiimide, N,N'-di(3,5-diisopropylphenyl)perylene-3,4,9,10-tetracarboxydiimide, N,N'-di(3-methyl-5-isopropylphenyl)perylene-3,4,9,10-tetracarboxydiimide, N,N'-di(3-ethyl-5-isopropylphenyl)perylene-3,4,9,10-tetracarboxydiimide, N,N'-di(3,5-dibutylphenyl)perylene-3,4,9,10-tetracarboxidiimide, N,N'-di(3,5-ditert-butylphenyl)-perylene-3,4,9,10-tetracarboxydiimide, N,N'-di(3,5-dipentylphenyl)perylene-3,4,9,10-tetracarboxydiimide, and N,N'-di(3,5-dihexylphenyl)perylene-3,4,9,10-tetracarboxydiimide.

Among perylene type compounds enuemerated above, those possessing alkyl groups of 1 to 4 carbon atoms, especially N,N'-di(3,5-dimethylphenyl)perylene-3,4,9,10-tetracarboxydiimide, prove to be particularly desirable. The perylene type compounds mentioned above are used either singly or in the form of a mixture of two or more members.

Of the diamine derivatives represented by the general formula (2-*a*) mentioned above, the preferred p-phenyl enediamine derivatives which satisfy this general formula by having 1 and l include 1,4-bis (N,N-disphenylamino)benzene,1-(N,N-diphenylamino-4-[N-(3-methylphenyl)-N-phenylamino]benzene, 1-[N-(2-methylphenyl)-N-phenylamino]-4-[N-(4-methylphenyl-N-phenylamino]-benzene, 1,4-bis[N,N-di(3-methylphenyl-)amino]-2-chlorobenzene, 1,4-bis[N-3-tert-butylphenyl)-N-phenylamino]-2-methylbenzene, 1-[N-(3-methylphenyl)-N-phenylamino]-4-[N-(3-ethoxyphenyl)-N-phenylamino]benzene, 1,4-bis[N-(3-methoxyphenyl)-N-phenylamino]-2-methoxybenzene, 1,4-bis[N-(3-tert-butoxyphenyl)-N-phenylamino]-2-methylbenzene, 1,4-bis[N-(2-chlorophenyl)-N-phenylamino]-benzene, 1,4-bis[N,N-di(3-bromophenyl)-amino]benzene; 1-[N-(3,5-dimethylphenyl)-N-phenylamino]-4-(N,N-diphenylamino)benzene, 1,4-bis(3,5-dimethylphenyl)amino]-2-methylbenzene, 1,4-bis[N-(3,5-dimethylphenyl)-N-phenylamino]-2-methoxybenzene, 1,4-bis[N-(3,5-dibutylphenyl)-N-phenylamino]benzene, 1-[N,N-di(3,5-di-tert-butylphenyl)amino]-4-(N,N-diphenylamino)benzene, 1-[N,N-di(3,5-diisopropoxyphenyl)-amino]-4-(N,N-diphenylamino)benzene, 1,4-bis[N-(3,5-di-tert-butoxyphenyl)-N-phenylamino]benzene, 1-[N,N-di(2,4-dichlorophenyl)amino]-4-[N,N-di(2,6-dichlorophenyl)amino]benzene, 1,4-bix[N-(3,5-dichlorophenyl)-N-phenylamino]-2-chlorobnzene, and 1,4-bis[N,N-bis-(3,5-dibromophenyl)amino]benzene, for example.

Of the diamine derivatives represented by the general formula (2-*a*), the preferred benzidine derivatives which satisfy the general formula by having 2 for l include 4,4'-bis(N,N-diphenylamino)dipheynl, 4'-bis[N-(3-methylphenyl)-N-phenylamino]-3,3-dimethoxydiphenyl, 4,4'bis[N,N-di(3-methylphenylamino)-3,3'-dimethyl]diphenyl, 4,4'-bis[N,N-di(4-methylphenylamino)-

3,3'-dimethyl]diphenyl, 4,4'-bis[N-(3-methylphenyl)-N-phenylamino]-3,3'-dichlorodiphenyl, 4,4'-bis[N,N-di(3-ethylphenyl)-N-phenylamino]-3,3'-dimethyldiphenyl, 4,4'-bis[N-(3-tert-butylphenyl)-N-phenylamino]diphenyl, 4,4'-bis[N,N-di(3-methoxyphenyl)amino]-3,3'-dimethoxydiphenyl, 4,4'-bis [N-(2-chlorophenyl)-N-phenylamino]-diphenyl, 4-[N-(2-chlorophenyl)-N-phenylamino]-4'-[N-(4-chlorphenyl)-N-phenylamino]-diphenyl, 4,4'-bis[N,N-di(3-chlorophenyl)amino]-3,3'-dichlorodiphenyl; 4-[N-(3,5-dimethylphenyl)-N-phenylamino]-4'-(N,N-diphenylamino)diphenyl, 4-[N,N-di(2,4-dimethyphenyl)amino]-4'-[N,N-di(2,6-dimethylphenyl)-amino]diphenyl, 4,4'-bis[NmN-di(3,5-dimethylphenyl)amino]-2,2'-dimethyldiphenyl, 4,4'-bis[N-(3,5-dimethylphenyl)-N-phenylamino]-2,2-dichlorodiphenyl, 4,4'-bis[N-(3,5-di-tertbutylphenyl)-N-phenylamino]diphenyl, 4,4'-bis [N,N-di-(3,5-dimethoxyphenyl)amino]-2,2-dimethyldiphenyl, 4-[N,N-di(3,5-diisopropoxyphenyl)amino]-4'-(N,N-diphenylamino)diphenyl, 4,4'-bis[N,N-di(3,5-diisopropoxyphenyl)amino]diphenyl, 4,4'-bis[N-(2,4-dichlorophenyl)-N-phenylamino]diphenyl, and 4,4'-bis[N,N-di(3,5-dichlorophenyl)amino]-2,2-dichlorodiphenyl, for example.

Of the diamine derivatives represented by the general formula (2-*a*), the preferred 4,4''-terphenyldiamine derivatives which satisfy the general formula by having 3 for l include 4,4''-bis(N,N-diphenylamino)-1,1':4',1'-terphenyl, 4-[N-(2-methylphenyl)-N-phenylamino]-4''-[N-(4-methylphenyl)-N-phenylamino]-1,1':4',1''-terphenyl, 4,4''-bis[N-(3-methylphenyl)-N-phenylamino]-3,3',3''-trimethyl-1,1':4'', 1''-terphenyl, 4,4''-bis[N-(3-methylphenyl)-N-phenylamino]-3,3',3''-trichloro-1,1':4',1''-terphenyl, 4-[N-2-methoxyphenyl)-N-phenylamino]-4''-[N-(3-methoxyphenyl)-N-phenylamino]-1,1':4',1''-terphenyl, 4,4''-bis[N-(3-isobutoxyphenyl)-N-phenylamino]-1,1':4',1''-terphenyl, 4-[N-(2chlorophenyl)-N-phenylamino-4''-[N-(4-chlorophenyl)-N-phenylamino]-1,1':4',1''-terphenyl, 4,4''-bis [N,N-di(4-chlorophenyl)amino]-1,1':4',1''-terphenyl; 4-[N-(3,5dimethylphenyl)-N-phenylamino]-4''(N,N-diphenylamino)-1,1':4',141-terphenyl, 4-[N,N-di(2,4-dimethylphenyl)-amino]-4''-[N,N-di(2,6-dimethylphenyl)amino]-1,1':4',1''-terphenyl, 4,4'-bis[N-(3,5-dimethylphenyl)-N-phenylamino]-3,3',3''-trimethyl-1,1':4',1''-terphenyl, 4,4''-bis[N,N-di(3,5-dimethylphenyl)amino]-3,3''-dimethoxy-1,1':4',1''-terphenyl, 4,4''-bis[N-(2,4-dimethoxyphenyl)-N-phenylamino]-1,1':4'',1''-terphenyl, 4-[N,N-di(2,4-dimethoxyphenyl-)amino]-4''-[N,N-di(2,6-dimethoxyphenyl)amino]1,1':-4',1''-terphenyl, 4,4''-bis[N,N-di(3,5-dipropoxyphenyl-)amino]-1,1':4',1''-terphenyl, 4,4''-bis[N,N-di(3,5-dibutoxyphenyl)amino]-1,1',4',1''-terphenyl, 4,4''-bis[N-(2,4-dichlorophenyl)-N-phenylamino]-1,1':4',1:-terphenyl, and 4-[N,N-di(2,6-dichlorophenyl)amino]-4''-[N,N-di(3,5-dichlorophenyl)amino]-1,1':4',1''-terphenyl, for example.

Of the diamine derivatives represented by the general formula (2-*b*) mentioned above, the preferred p-phenylenediamine derivatives which satisfy the general formula by having 1 for l include 1,4-bis(N-naphthyl-N-phenylamino)benzene, 1,4-bis[N-(6-methylnaphthyl)-N-phenylamino]benzene, 1,4-bix[N-(6-methylnaphthyl)-N-(3-methylphenyl)amino]benzene, 1,4-bis[N-(6-methylnaphthyl)-N-phenylamino]-2-methoxybenzene, 1,4-bis[N-(6-methylnaphthyl)-N-phenylamino]-2-chlorobenzene, 1,4-bis[N-(6butylnaphthyl)-N-phenylamino]benzene, 1,4-bis[N-(6-ethoxynaphthyl)-N-phenylamino]benzene, 1,4-bis[N-(6-tert-butoxynaphthyl)-N-phenylamino]-2-chlorobenzene, 1,4-bis[N-(6-chloronaphthyl)-N-phenylamino]benzene, 1,4-bis[N-(8-chloronaphthyl)-N-phenylamino]benzene, 1,4-bis[N-(6-chloronaphthyl)-N-(3-chlorophenyl)amino]benzene, for example.

Of the diamine derivatives represented by the general formula (2-*b*) mentioned above, the preferred benzidine derivatives which satisfy this general formula by having 2 for l include 4,4'-bis(N-naphthyl-N-phenylamino)-diphenyl, 4,4'-bis[N-(3-methylnaphthyl)-N-phenylamino]diphenyl, 4,4'-bis[N-(6-methylnaphthyl)-N-phenylamino]-3,3'-dimethyldiphenyl, 4,4'-bis[N-(6-methylnaphthyl)-N-phenylamino]-3,3'-dichlorodiphenyl, 4,4'-bis[N-(6-isobutylnaphthyl)-N-phenylamino]-diphenyl, 4,4'-bis[N-(2-methoxynaphtyl)-N-phenylamino]disphenyl, 4-[N-(3-methoxynaphthyl)-N-phenylamino]-4'-[N-(6-methoxynaphtyl)-N-phenylamino]diphenyl, 4,4'-bis[N-(6-butoxynaphthyl)-N-phenylamino]diphenyl, 4,4'-bis[N-(4-chloronaphthyl)-N-phenylamino]diphenyl, and 4,4'-bis[N-(6-chloronaphthyl)-N-phenylamino]-3,3'-dichlorophenyl, for example.

Of the diamine derivatives represented by the general formula (2-*b*) mentioned above, the preferred 4,4''-terphenyldiamine derivatives which satisfy this general formula by having 3 for l include 4,4''-bis[N-naphthyl-N-phenylamino)-1,1':4', ''''-terphenyl, 4,4''-bis[N-(2-methylnaphthyl)-N-phenylamino]-1,1':4',1''-terphenyl, 4-[N-(3-methylnaphthyl)-N-phenylamino]-4''-[N-(6-methylnaphthyl)-N-phenylamino]-1,1':4', 1''-terphenyl, 4,4''-bis[N-(6-methylnaphthyl)-N-phenylamino]-3,3''-dimethyl-1,1':4',1''-terphenyl, 4-[N-(3-methoxynaphthyl)-N-phenylamino]-4''-[N-(6-methoxynaphthyl)-N-phenylamino]-1,1':4',1''-terphenyl, 4,4''-bis[N-(6-butoxynaphthyl)-N-phenylamino]-1,1':4',1''-terphenyl, 4,4''-bis[N-(6-chloronaphthyl)-N-phenylamino]-1,1':4',1''-terphenyl, and 4-[N-(4-chloronaphthyl)-N-phenylamino-4''[N-(5-chloronaphtyl)-N-phenylamino]-1,1':4',1''-terphenyl, for example.

Of the diamine derivatives represented by the general formula (2-*c*) mentioned above, the preferred p-phenylenediamine derivatives which satisfy this general formula by having 1 for l include 1,4-bis(N,N-dinaphthylamino)benzene, 1(N,N-dinaphthylamino)-4-[N-(6-methylnaphtyl)-N-naphthylamino]benzene, 1-[N-(6-methylnaphthyl)-N-naphthylamino]-4-[N-(8-methylnaphthyl)-N-naphthylamino]benzene, 1,4-bis[N,N-di(6-methylnaphthylamino]-2-methylbenzene, 1,4-bis[N-(6-methylnaphthyl)-N-naphthylamino]-2-methoxybenzene, 1,4-bis[N-(6-methylnaphthyl)-N-naphthylamino]-2-chlorobenzene, 1,4-bis[N,N-di(6-butylnaphthyl-)amino]benzene, 1-[N,N-di(6-ethylnaphthyl)amino]-4-[N,N-di(6-methoxynaphthyl)amino]benzene, 1,4-bis[N,N-di(4-methoxynaphthyl)amino]benzene, 1,4-bis[N-(4-methoxynaphthyl)-N-(6-methoxynaphthyl-)amino]benzene, 1,4-bis[N-(6-tert-butoxynaphthyl)-N-naphthylamino]benzene, 1,4-bis[N-(6-tertbutoxynaphthyl)-N-naphthylamino]-2-chlorobenzene, and 1,4-bis[N-(8-chloronaphthyl)-N-naphthylamino]-benzene, for example Of the diamine derivatives represented by the general formula (2-*c*) mentioned above, the preferred benzidine derivatives which satisfy this general formula by having 2 for l include 4,4'-bis(N,N-dinaphthylamino)diphenyl, 4,4'-bis[N-(3-methylnaphthyl)-N-naphthylamino]diphenyl, 4,4'-bis[N,N-di(4-methylnaphthyl)amino]diphenyl, 4,4'-bis[N-(6-methylnaphthyl)-N-naphtylamino]-3,3'- dimethoxydiphenyl, 4,4'-bis[N,N-di(6-methylnaphthyl-)amino]-3,3'-dichlorodiphenyl, 4,4'-bis[N-(6-propylnaphthyl)-N-naphthylamino]diphenyl, 4,4'-bis[N-(3-methoxynaphthyl)-N-naphthylamino]diphenyl, 4,4'-bis[N-(6-methoxynaphthyl)-N-naphthylamino)-3,3'-dichlorodiphenyl, 4,4'-bis[N,N-di(6isobutoxynaphthyl-)amino]diphenyl, 4,4'-bis[N-(4-chloronaphthyl)-N-naphthylamino]diphenyl, 4,4'-bis[N-(3-chloronaphthyl)-N-(6-chloronaphthyl)amino]diphenyl, 4,4'-bis[N,N-di(6-bromonaphthyl)amino]diphenyl, for example.

In the diamine derivatives represented by the general formula (2-*c*) mentioned above, the preferred 4,4''-terphenyldiamine derivatives which satisfy this general formula by having 3 for l include 4,4''-bis(N,N-dinaphthylamino)-1,1':4',1''-terphenyl, 4,4''-bis[N-(3-methylnaphthyl)-N-naphthylamino]-1,1':4',1''-terphenyl, 4-[N-(6-naphthyl)-N-naphthylamino]-4''-[N-(8-methylnaphthyl)-N-naphthylamino]-1,1':4',1''-terphenyl, 4,4''-bis[N-(6-methylnaphthyl)-N-naphthylamino]-3,3',3''-trimethyl-1,1':4',1''-terphenyl, 4,4''-bis[N,N-di(6-methylnaphthyl)amino]-3,3',3''-trichloro-1,1':4',1''-terphenyl, 4-[N-(6-methoxynaphthyl)-N-naphthylamino]-4''-[N-(8-methoxynaphthyl)-N-naphthylamino]-1,1':4',1''-terphenyl, 4,4''-bis[N,N-di(6-propoxynaphthyl)amino]-1,1':4',1''-terphenyl, 4,4''-bis[N,N-di(6-tert-butoxynaphthyl)amino]-1,1':4',1''-terphenyl, 4,4''-bis[N-(8-chloronaphthyl)-N-naphthylamino]-1,1':4',1''-terphenyl, and 4,4''-bis[N-(3-chloronaphthyl)-N-(6-chloronaphthyl)-amino]-1,1':4',1''-terphenyl, for example.

These diamine derivatives are used either singly or in the form of a mixture of two or more members.

The diamine derivatives described above enjoy excellent symmetry of moleculars, induce no isomerization on exposure to light like such conventionally used electric charge transferring substances as 4-(N,N-diethylamino)benzaldehyde-N,N-diphenyl hydrazone and N-methyl-3-carbazolyl aldehyde-N,N-diphenylhydrazone, excel in photostability. These diamine derivatives exhibit high drift mobility and low dependency of the drift mobility upon the field intensity. Now, the quality of these diamine derivatives will be described more specifically below with the respect to 4,4'-bis[N-(3-methylphenyl)-N-phenylamino]diphenyl (Compound A), 4,4'-bis[N-(3,5-dimethylphenyl)-N-phenylamino]-diphenyl (Compound B), 4,4'-bis[N-(6-methylnaphthyl)-N-phenylamino]diphenyl (Compound C), and 4,4'-bis[N-(6-methylnaphthyl)-N-naphthylamino]diphenyl (Compound D) taken as examples. On exposure to a low electric field of $2.0\times10^5$ V/cm$^2$ and a high electric field of $5.0\times10^5$ C/cm$^2$, these compounds exhibit large drift mobility and small dependency on field intensity as shown in the following table, as compared with polyvinyl carbazole (Compound E), N-ethyl-3-carbazolyl aldehyde-N,N-diphenyl hydrazone (Compound F), and 1-phenyl-3-(4-diethylaminostyryl)-5-(4-diethylaminophenyl)pyrazoline (Compound G).

When a single-layer type sensitive layer is obtained by the combination of a diamine derivative of the quality just described with a perylene type compound already described, the sensitive material using the single-layer type sensitive layer enjoys high sensitivity and small residual potential in spite of the single-layer configuration.

| | Drift mobility ($\times 10^{-6}$ cm/V · sec.) | |
|---|---|---|
| | Low field | High field |
| Compound A | 2.1 | 2.7 |
| Compound B | 1.8 | 2.5 |
| Compound C | 1.4 | 2.1 |
| Compound D | 1.3 | 2.0 |
| Compound E | 0.18 | 0.65 |
| Compound F | 0.45 | 1.0 |
| Compound G | 0.11 | 0.31 |

The compounds represented by the general formula (2) mentioned above can be produced by various methods. The compounds represented by the general formula (2-*a*), for example, can be produced by causing a compound represented by the following general formula (5) to react either simultaneously or sequentially with compounds represented severally with the general formulas (6) to (9).

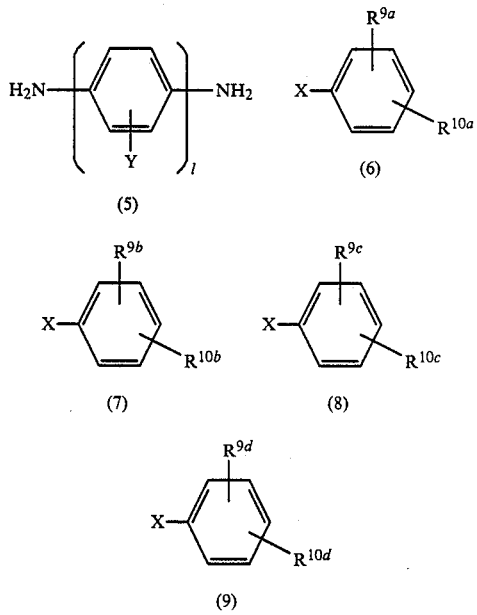

wherein $R^{9a}$ to $R^{9d}$, $R^{10a}$ to $R^{10d}$, Y, and l have the same meanings as defined above and X stands for a halogen atom.

The reactions of the compounds represented by the general formula (5) with the compounds represented respectively by the general formulas (6) to (9) are generally carried out in an organic solvent. The organic solvent is only required to be incapable of adversely effecting these reactions. Examples of the organic solvent usable include nitrobenzene, dichlorobenzene, quinoline, N,N-dimethylformamide, N-methyl pyrrolidone, and dimethyl sulfoxide. The reactions are carried out generally at a temperature in the range of 150° to 250° C. in the presence of a catalyst of copper powder, copper oxide, or a copper halogenide and such a basic substance as sodium hydroxide, potassium hydroxide, sodium carbonate, potassium carbonate, sodium hydrogen carbonate, or potassium hydrogen carbonate.

In the compounds represented by the general formula (2-*a*), those which restrict the positions of the substituents $R^{9a}$ to $R^{9d}$ and $R^{10a}$ to $R^{10d}$ in the molecular configuration and, at the same time, require configurational symmetry can be produced by causing a compound represented by the following general formula (10) to react with compounds represented by the general formulas (6) and (8) thereby forming a compound represented by the general formula (11), subsequently hydrolyzing the compound of the general formula (11) thereby expelling acyl groups and forming a compound represented by the general formula (12), and further causing this compound of the general formula (12) to react with the compounds represented by the general formulas (7) and (9).

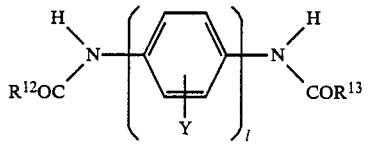

(10)

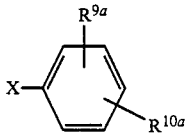

(6)

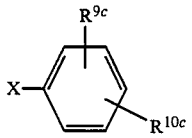

(8)

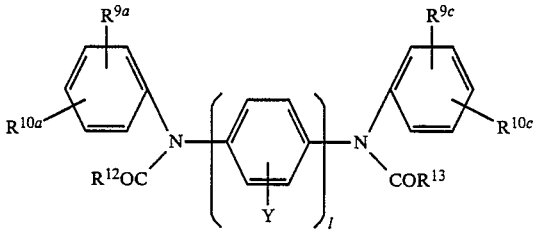

(11)

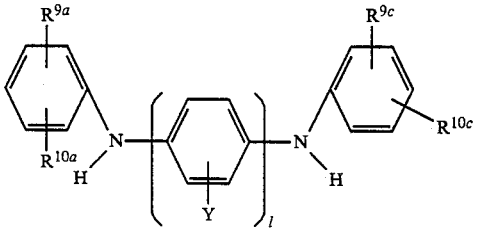

(12)

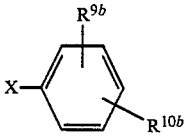

(7)

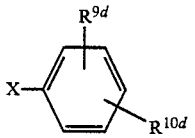

(9)

wherein $R^{12}$ and $R^{13}$ independently stand for a lower alkyl group and $R^{9a}$ to $R^{9d}$, $R^{10a}$ to $R^{10d}$, Y, and l have the same meaning as defined above.

The reaction of the compound represented by the general formula (10) mentioned above with the compounds represented by the general formula (6) and (8) can be carried out in the same manner as the reaction of the compound represented by the general formula (5) mentioned above with the compounds represented by the general formulas (6) to (9). The reaction for the expulsion of acyl groups from the compound represented by the general formula (11) by the hydrolysis can be carried out by the conventional method in the presence of a basic catalyst. The reaction of the compound represented by the general formula (12) with the compounds represented by the general formulas (7) and (9) can be carried out in the same manner as the reaction of the compound represented by the general formula (5) mentioned above with the compounds represented by the general formulas (6) to (9).

The compounds represented by the general formulas (2-*b*) and (2-*c*) can be synthesized in the same manner as the compounds represented by the general formula (2-*a*) are synthesized.

After completion of the reaction, the reaction mixture is concentrated, and then the compounds aimed at can be easily separated and purified by the conventional procedure such as recrystallizing, solvent-extracting, or column chromatography.

Examples of the binding resin include olefin type polymers such as styrene polymers, acrylic polymers, styrene-acrylic copolymers, polyethylene, ethylene-vinyl acetate copolymers, chlorinated polyethylene, polypropylene, and ionomers; polyvinyl chloride, vinyl chloride-vinyl acetate copolymer, polyesters, alkyd resins, polyamides, polyurethanes, epoxy resins, polycarbonates, polyarylates, polysulfones, diallyl phthalate resins, silicone resins, keton resins, polyvinyl butyral resins, polyether resins, and phenol resins, photosetting type resin such as epoxy acrylates; and various other similar polymers. Particularly for the purpose of heightening the sensitivity of the sensitive material, enhancing the compatibility with the diamine derivative and other materials mentioned above, the abrasionproofness of the sensitive material, and the repeating property, and amplifying the freedom in the selection of a solvent for dissolving the binding resin, it is desirable to use poly (4,4'-cyclohexylidene diphenyl)carbonate. In terms of the stability of a solution to be formed, poly(4,4'-cyclohexylidene diphenyl)-carbonate permits use of a ketone type solvent such as tetrahydrofuran or methyl-ethyl ketone unlike the bisphenol-A type polycarbonate which barely permits use of a chlorine type solvent such as dichloromethane or monochlorobenzene only. Thus, it is favorable from the standpoint of safety and hygiene and is easy to handle. To ensure efficient use, the poly(4,4'-cyclohexylidene diphenyl)carbonate is desired to be of the quality having a polymerization degree approximately in the range of 50 to 5,000. The binding resins enumerated above are used either singly or in the form of a mixture of two or more members.

Though the relative amounts of the perylene type compound, diamine derivative, and binding resin mentioned above to be used herein are not specifically restricted but may be freely selected to suit the particular properties which the produced electrophotographic sensitive materials expected to possess, it is generally desirable to use the perylene type compound in an amount in the range of 2 to 20 parts by weight, preferably 3 to 15 parts by weight and the diamine derivative in an amount in the range of 40 to 200 parts by weight, preferably 50 to 100 parts by weight, based on 100 parts by weight of the binding resin. If the amounts of the perylene type compound and the diamine derivative are smaller than the respective lower limits mentioned above, the produced sensitive material not merely exhibits insufficient sensitivity but also suffers from large residual potential. If these amounts exceed the respective upper limits, the produced sensitive material is deficient in such properties as wear resistance.

In the conventional sensitive material, the positively charging property is not sufficient if the perylene type compound is used in an unduly large amount and the sensitivity is less than is necessary if the compound is used in an unduly small amount. In contrast, the electrophotographic sensitive material of the present invention exhibits high sensitivity and surface potential and small residual potential and excels in positively charging property even when the amount of the perylene type compound to be used is small, because of the combination of a specific perylene type compound and a specific diamine derivative.

Though the sensitive material which is furnished with the single-layer type sensitive layer of the composition and construction described above exhibits sufficient electrophotographic properties because of high sensitivity and small residual potential, it is desired to incorporate therein a spectral sensitizer so as to acquire enhanced spectral sensitivity. As the spectral sensitizer, a phthalocyanine type compound which functions as an electric charge generating substance is advantageously used. Examples of phthalocyanine type compound include aluminum phthalocyanines and copper phthalocyanines of various crystal forms such as the $\alpha$ type, $\beta$ type, and $\gamma$ type. It is particularly desirable to use a metal-free phthalocyanine and/or titanyl phthalocyanine.

Though the phthalocyanine type compound may possess a suitable particle diameter, it is desired to possess an average particle diameter of not more than 0.1 $\mu$m. If the average particle diameter of the metal-free phthalocyanine exceeds 0.1 $\mu$m, the sensitive material is deficient in sensitivity. The phthalocyanine type compound may be used in a suitable amount. Desirably, however, it is used in an amount in the range of 0 to 2 parts by weight, based on 100 parts by weight of the binding resin. If the amount of the phthalocyanine type compound to be added exceeds 2 parts by weight, the reproducibility of red color is not sufficient because this compound possesses a spectral sensitivity in the long wavelength region.

Optionally, the single-layer type sensitive layer of the composition described above may incorporate therein other electric charge generating substance and electric charge transferring substance in amounts incapable of impairing the sensitive properties. The electric charge generating substances available for this incorporation include selenium, seleniumtellurium, amorphous silicon, pyrylium salts, azo type compounds, disazo type compounds, anthanthrone type compounds, indigo type compounds, triphenylmethan type compounds, threne type compounds, toluidine type compounds, pyrazoline type compounds, other perylene type compounds, and quinacridone type compounds, for example. The electric charge transferring substances available for the incorporation include tetracyanoethylene; fluorenone type compounds such as 2,4,7-trinitro-9-fluorenone; nitro type compounds such as 2,4,8-trinitrothioxanthone and dinitroanthracene; oxadiazole type compounds such as succinic anhydride, maleic anhydride, dibromomaleic anhydride, and 2,5-di(4-dimethylamniophenyl)-1,3,4-oxadiazole; styryl type compounds such as 9-(4-diethylaminostyryl)anthracene; carbazole type compounds such as polyvinyl carbazole; pyrazoline type compounds such as 1-phenyl-3-(p-dimethylaminophenyl)pyrazoline; indole type compounds, oxazole type compounds, isooxazole type compounds, thiazole type compounds, thiadiazole type compounds, imidazole type compounds, pyrazole type compounds, triazole type compounds, and other similar nitrogen-containing cyclic compounds, and fused polycyclic compounds, for example.

The sensitive layer may incorporate therein various additives such as, for example, the conventional sensitizers represented by terphenyls, halonaphthoquinones, and acenaphtylenes, fluorene type compounds represented by 9-(N,N-diphenylhydrazino) fluorene and 9-carbazolyliminofluorene; plasticizers; and degradation-proofing agents represented by antioxidant and ultraviolet absorbent.

The thickness of the single-layer type sensitive layer containing a perylene type compound, a diamine derivative, and a binding resin as described above is not critical. It is, however, desired to be in the range of 10 to 50 $\mu$m, preferably 15 to 25 $\mu$m.

The electrophotographic sensitive material described above can be formed by preparing a dispersion liquid of the aforementioned perylene compound and other raw materials, applying the dispersion liquid on an electroconductive substrate, and removing the solvent from the applied layer.

The electroconductive substrate may be in the form of sheet or a drum. Desirably the substrate itself or the surface of the substrate possesses electroconductivity and retains mechanical strength capable of enduring in the actual use. Various substances possessing electroconductivity are available as the electroconductive substrate. They include simple metals such as aluminum, copper, tin, platinum, gold, silver, vanadium, molybdenum, chromium, cadmium, titanium, nickel, palladium, indium, stainless steel, and brass; plastic materials having such metals vacuum deposited or superposed thereon; and glass materials coated with aluminum iodide, tin oxide, and indium oxide, for example. In the electroconductive substances enuemerated above, aluminum, especially aluminum provided with an oxidized membrane, which is available in the name of "Alumite", "Eloxal" or "Alumilite", for the purpose of precluding occurrence of black points and pinholes in copied images, and, at the same time, enhancing tight adhesiveness of the substrate to the sensitive layer containing the perylene type compound, the diamine derivative, etc., is used advantageously. Preferably, the oxidized membrane formed on the aluminum has a thickness in the range of 5 to 12 $\mu$m and a surface roughness of not more than 1.5 S.

In the preparation of the dispersion mentioned above, an organic solvent freely selected to suit the particular kind of the binding resin, etc. can be used. The organic solvents available for the preparation include aliphatic hydrocarbons such as n-hexane, octane, and cyclohexane; aromatic hydrocarbons such as benzene, toluene, and xylene; halogenated hydrocarbons such as dichloromethane, dichloroethane, carbon tetrachloride, and chlorobenzene, ethers such as dimethyl ether, diethyl ether, tetrahydrofuran, ethylene glycol dimethyl ether, ethylene glycol diethyl ether, and diethylene glycol dimethyl ether; ketones such as acetone, methylethyl ketone, and cyclohexanone; esters such as ethyl acetate and methyl acetate; dimethyl formamide and dimethyl sulfoxide, for example. They are used either singly or in the form of a mixture of two or more member. The preparation of the dispersion liquid may be carried out in the presence of a surfactant or leveling agent for the purpose of improving dispersibility and applicability.

The dispersion liquid can be prepared by the conventional method using a ball mill, a paint shaker, a sand mill, an attriter, or an ultrasound dispersing device, for example. By applying the dispersion liquid so prepared to the electroconductive substrate and heating to remove the solvent, the electrophotographic sensitive material of the present invention can be obtained.

Optionally, an undercoating layer may be interposed between the electroconductive substrate and the sensitive layer for the purpose of enhancing the adhesiveness of the electroconductive substrate to the sensitive layer. The undercoating layer can be formed by preparing a solution of a natural or synthetic macromolecular compound, applying this solution to a given surface in an amount calculated to produce a dry layer approximately 0.01 to 1 μm in thickness, and drying the applied layer of the solution. A surface protecting layer may be formed on the sensitive layer for the protection of the sensitive layer. The surface protecting layer is formed by preparing a solution of a suitably selected binding resin or a mixed solution of the binding resin with other additive such as an antioxidant, applying this solution on a given surface in an amount calculated to form a dry layer approximately 0.1 to 10 μm, preferably 0.2 to 5 μm, in thickness, and drying the applied layer of the solution.

Since the sensitive layer contains specific perylene type compound and diamine derivative, the electrophotographic sensitive layer of this invention excels in positively charging property and photostability and, in spite of the single-layer configuration of the sensitive layer, exhibits high sensitivity and surface potential and enjoys small residual potential. Since the sensitive layer possessed by the sensitive material is the single-layer type, the electrophotographic sensitive material can be manufactured inexpensively in high yield. Thus, the electrophotographic sensitive material of the present invention is useful as a sensitive material for a copying machine or a laser beam printer.

Now, this invention will be described more specifically below with reference to working examples.

EXAMPLES

Example 1

A dispersion liquid for the formation of a single-layer type sensitive layer was prepared by mixing 100 parts by weight of poly(4,4'-cyclohexylidenediphenyl)carbonate (produced by Mitsubishi Gas Chemical Industries Ltd. and marketed under trademark designation of "Polycarbonate Z"), 8 parts by weight of N,N'-di(3,5-dimethylphenyl)perylene-3,4,9,10-tetracarboxydiimide, 0.6 part by weight of metal-free phthalocyanine, 100 parts by weight of 4,4'-bis[N-(3-methylphenyl)-N-phenylamino]biphenyl, and a prescribed amount of tetrahydrofuran in a ballmill for 24 hours. This dispersion liquid was applied on an aluminum sheet which was subjected to oxidation treatment on the surface thereof. Consequently, there was obtained an electrophotographic sensitive-material furnished with a sensitive layer of approximately 20 μm in thickness.

Examples 2 to 15

Electrophotographic sensitive materials were obtained by following the procedure of Example 1, excepting the following diamine derivatives were severally used in the place of 4,4'-bis[N-(3-methylphenyl)-N-phenylamino]biphenyl.

Example 2—4,4'-bis[N-(3-methoxyphenyl)-N-phenylamino]biphenyl
Example 3—4,4-bis[N-(3-chlorophenyl)-N-phenylamino]biphenyl
Example 4—4-[N-(2-methylphenyl)-N-phenylamino]-4'-[N-4-(methylphenyl)-N-phenylamino]biphenyl
Example 5—4-[N-(2-methylphenyl)-N-phenylamino]-4'-[N-(3-methylphenyl)-N-phenylamino]biphenyl
Example 6—1,4-bis[N-(3-methylphenyl)-N-phenylamino]benzene
Example 7—4,4''-bis[N-(3-methylphenyl)-N-phenylamino]-1,1':4',1''-terphenyl
Example 8—4,4'-bis[N,N-di(4-methylphenyl)amino]-3,3''-dimethylbiphenyl
Example 9—4,4'-bis[N-(3,5-dimethylphenyl)-N-phenylamino]biphenyl
Example 10—4,4'-bis[N-(3,5-dimethoxyphenyl)-N-phenylamino]biphenyl
Example 11—4,4'-bis[N-(3,5-dichlorophenyl)-N-phenylamino]biphenyl
Example 12—4,4'-bis[N-(3,5-dimethylphenyl)-N-(3-methylphenyl)amino]biphenyl
Example 13—4-[N-(2,4-dimethylphenyl)-N-phenylamino]-4'-[N-(3,5-dimethylphenyl)-N-phenylamino]biphenyl
Example 14—1,4-bis[N-(3,5-dimethylphenyl)-N-phenylamino]benzene
Example 15—4,4''-bis[N-(3,5-dimethylphenyl)-N-phenylamino]-1,1':4',1''-terphenyl

Examples 16 to 22

Electrophotographic sensitive materials were prepared by following the procedure of Example 1, excepting the following diamine derivatives were used in the place of 4,4'-bis[N-(3-methylphenyl)-N-phenylamino]-biphenyl.

Example 16—4,4'-bis[N-(6-methylnaphthyl)-N-phenylamino]biphenyl
Example 17—4,4'-bis[N-(6-methoxynaphthyl)-N-phenylamino]biphenyl
Example 18—4,4'-bis[N-(6-chloronaphthyl)-N-phenylamino]biphenyl
Example 19—4-[N-(6-methylnaphthyl)-N-phenylamino]-4'-[N-(6-methylnaphthyl)-N-(3-methylphenyl)amino]biphenyl
Example 20—4-[N-(4-methylnaphthyl)-N-phenylamino]-4'-[N-(6-methylnaphthyl)-N-phenylamino]biphenyl
Example 21—4,4'-bis[N-(6-methylnaphthyl)-N-(3-methylphenyl)amino]biphenyl
Example 22—1,4-bis[N-(6-methylnaphthyl)-N-phenylamino]benzene
Example 23—4,4''-bis[N-(6-methylnaphthyl)-N-phenylamino]-1,1':4',1''-terphenyl Examples 24 to 31

Electrophotographic sensitive materials were prepared by following the procedure of Example 1, excepting the following diamine derivatives were used in the place of 4,4'-bis[N-(3-methylphenyl)-N-phenylamino]-biphenyl.

Example 24—4,4'-bis[N-(6-methylnaphthyl)-N-naphthylamino]biphenyl
Example 25—4,4'-bis[N-(6-methoxhnaphthyl)-N-naphthylamino]biphenyl
Example 26—4,4'-bis[N-(6-chloronaphthyl)-N-naphthylamino]biphenyl Example 27—4-[N,N-di(6-methylnaphthyl)amino]-4'-[N-(6-methylnaphthyl)-N-naphthylamino]biphenyl Example 28—4-[N-(4-methylnaphthyl)-N-naphthylamino]-4'-[N-(6-methylnaphthyl)-N-naphthylamino]biphenyl Example 29—4,4'-bis[N,N-di(6-methylnaphthyl)-amino]biphenyl Example 30—1,4-bis[N-(6-methylnaphthyl)-N-naphthylamino]benzene Example 31—4,4''-bis[N-(6-methylnaphthyl)-N-naphthylamino]-1,1':4',1''-terphenyl Comparative Examples 1 to 4

Electrophotographic sensitive materials were prepared by following the procedure of Example 1, excepting the following electric charge transferring substances were used in the place of 4,4'-bis[N-(3-methylphenyl)-N-phenylamino]biphenyl.

Comparative Example 1—N-ethyl-3-carbazolylaldehyde-N,N-diphenyl hydrazone

Comparative Example 2—4-(N,N-diethylamino)benzaldehyde N,N-diphenyl hydrazone

Comparative Example 3—1-phenyl-3-(4-diethylaminostyryl)-5-(4,4-diethylaminophenyl)pyrazoline Comparative Example 4—Polyvinyl carbazole Comparative Examples 5 to 8

Electrophotographic sensitive materials were prepared by following the procedure of Example 1, excepting the following electric charge generating substances were used in the place of N,N'-di(3,5-dimethylphenyl)-perylene-3,4,9,10-tetracarboxydiimide.

Comparative Example 5—N,N'-di(4-methoxyphenyl)-perylene-3,4,9,10-tetracarboxydiimide Comparative Example 6—N,N'-di(2,4,6-trimethylphenyl)-perylene-3,4,9,10-tetracarboxydiimide Comparative Example 7—Dibromo anthanthrone Comparative Example 8—Metal-free phthalocyanine The sensitive materials furnished with a single-layer type sensitive layer as obtained in Examples 1 to 3, 9 and 10, 16 to 18, and 24 to 26 and sensitive materials furnished with a laminate-type sensitive layer using the same substances were compared in properties. The sensitive materials furnished with a laminate-type sensitive layer were prepared by using the same electric charge generating substances and electric charge transferring substances as used in the relevant working examples, and by the following procedure.

A dispersion liquid for the formation of an electric charge generating layer was prepared by mixing 100 parts by weight of polyvinyl butyral (produced by Sekisui Chemical Co., Ltd. and marketed under trademark designation of "S-lec C"), 100 parts by weight of a varying electric charge generating substance used in the relevant working example, 0.6 part by weight of metal-free phthalocyanine, and a prescribed amount of benzene in a ball mill for 24 hours. This dispersion liquid was applied on the same electroconductive substrate as used in Example 1 in an amount calculated to produce a dry layer approximately 0.5 μm in thickness, to give an electric charge generating layer.

Separately, a coating solution for the formation of the electric charge transfer layer was prepared by mixing 100 parts by weight of a polyester (produced by Toyo Spinning Co., Ltd. and marketed under trademark designation of "Bylon 200"), 70 parts by weight of a varying electric charge transferring substance used in the relevant working example, and a prescribed amount of tetrahydrofuran. By forming an electric charge transferring layer in a dry thickness of about 18 μm on the electric charge generating layer mentioned above, there was obtained an electrophotographic sensitive material furnished with a laminate-type sensitive layer corresponding to the relevant working example mentioned above.

Test

To test for charging property and sensitive property, the electroconductive sensitive materials furnished with a single-layer type sensitive layer obtained in the working examples and the comparative examples described above were positively charged by exposure to corona discharge at +6.0 KV with an electrostatic copying paper tester (produced by Kawaguchi Denki K. K. and marketed under product code of "SP-428"). The electrophotographic sensitive materials furnished with a laminate-type sensitive layer were negatively charged with corona discharge at −6.0 KV.

The sensitive materials were tested for surface potential, V s.p. (V), and were exposed to the light from a tungsten lamp 10 luxes in illuminance to find time required for the surface potential, V s.p., to decrease ½ of the original magnitude and compute the half-value amount of exposure, E ½ (uj/cm²). The surface potential obtained on elapse of 0.15 seconds after the exposure was reported as residual potential, V r.p. (V).

The electrophotographic sensitive materials obtained in the working examples and the comparative examples and the electrophotographic sensitive materials furnished with a laminate-type sensitive layer were tested for charge property and sensitive property. The results are shown in Table 1. In Table 1, "S" means a single layer, and "L" means a laminate layer.

TABLE 1

| Example No. | | V s.p. (V) | V r.p. (V) | E ½ (μJ/cm²) |
|---|---|---|---|---|
| 1 | S | 651 | 65 | 18.0 |
| | L | 649 | 70 | 38.3 |
| 2 | S | 648 | 67 | 18.1 |
| | L | 650 | 65 | 35.7 |
| 3 | S | 648 | 67 | 18.1 |
| | L | 658 | 69 | 18.4 |
| 4 | S | 653 | 70 | 18.3 |
| 5 | S | 646 | 74 | 19.7 |
| 6 | S | 652 | 77 | 21.6 |
| 7 | S | 648 | 83 | 21.2 |
| 8 | S | 651 | 60 | 16.1 |
| 9 | S | 655 | 65 | 18.0 |
| | L | 634 | 71 | 39.6 |
| 10 | S | 660 | 63 | 17.8 |
| | L | 644 | 68 | 35.2 |
| 11 | S | 643 | 64 | 17.2 |
| | L | 652 | 70 | 29.0 |
| 12 | S | 664 | 68 | 19.4 |
| 13 | S | 645 | 77 | 18.8 |
| 14 | S | 657 | 83 | 20.7 |
| 15 | S | 656 | 80 | 20.4 |
| 16 | S | 655 | 65 | 18.0 |
| | L | 657 | 73 | 34.7 |
| 17 | S | 651 | 76 | 20.0 |
| | L | 643 | 82 | 36.2 |
| 18 | S | 649 | 74 | 19.7 |
| | L | 662 | 70 | 33.3 |
| 19 | S | 659 | 75 | 18.4 |
| 20 | S | 642 | 75 | 18.4 |
| 21 | S | 660 | 78 | 19.7 |
| 22 | S | 660 | 69 | 18.3 |
| 23 | S | 652 | 79 | 20.3 |
| 24 | S | 655 | 65 | 18.0 |
| | L | 661 | 75 | 33.3 |
| 25 | S | 649 | 80 | 21.1 |
| | L | 649 | 77 | 35.6 |

TABLE 1-continued

| | | | | |
|---|---|---|---|---|
| 26 | S | 659 | 77 | 19.9 |
| | L | 659 | 80 | 36.2 |
| 27 | S | 660 | 83 | 19.7 |
| 28 | S | 659 | 86 | 20.2 |
| 29 | S | 643 | 76 | 18.9 |
| 30 | S | 661 | 77 | 18.9 |
| 31 | S | 661 | 84 | 21.1 |
| Comparative | | V s.p. (V) | V r.p. (V) | E ½ (μJ/cm²) |
| Example 1 | S | 655 | 80 | 25.0 |
| Example 2 | S | 650 | 118 | 37.0 |
| Example 3 | S | 645 | 105 | 37.5 |
| Example 4 | S | 645 | 125 | 40.0 |
| Example 5 | S | 649 | 110 | 37.5 |
| Example 6 | S | 660 | 98 | 34.4 |
| Example 7 | S | 655 | 102 | 35.8 |
| Example 8 | S | 653 | 95 | 32.2 |

It is clearly understood from Table 1 that the electrophotographic sensitive materials of the working examples invariably exhibited small half-value amounts, excelled in sensitivity, and enjoyed small residual potentials as compared with the sensitive materials of the comparative examples which invariably were deficient in sensitivity and suffered from large residual potentials.

To test for change of quality due to exposure to light, the electrophotographic sensitive materials obtained in Examples 1, 9, 16, and 24 and Comparative Experiment 1 were exposed to the light from a light source 1,000 luxes in illuminance for five minutes and then tested for the same properties as mentioned above to find differences of properties before and after the exposure. The results are shown in Table 2.

TABLE 2

| | Δ V s.p. | Δ V r.p. | Δ E ½ |
|---|---|---|---|
| Example No. 1 | −20 | −5 | −1.5 |
| Example No. 9 | −19 | −6 | −1.6 |
| Example No. 16 | −20 | −8 | −1.8 |
| Example No. 24 | −22 | −9 | −1.7 |
| Comparative Example 1 | +180 | +110 | +23 |

It is clearly understood from Table 2 that the sensitive materials of the working examples experienced small changes in charging property and sensitive property due to exposure to light, indicating that they would exhibit stable properties even under the impact of repeated use, whereas the sensitive material of Comparative example 1 suffered from notable changes in surface potential and residual potential a heavy decline of sensitivity, indicating that it would not exhibit sufficient properties under the impact of repeated use.

What is claimed is:

1. An electrophotographic sensitive material provided with a single-layer type sensitive layer containing an electric charge generating substance, an electric charge transferring substance, and a binding resin, characterized in that said electric charge generating substance is a perylene type compound represented by the following general formula (1) and said electric charge transferring substance is a diamine derivative represented by the following general formula (2):

(1)

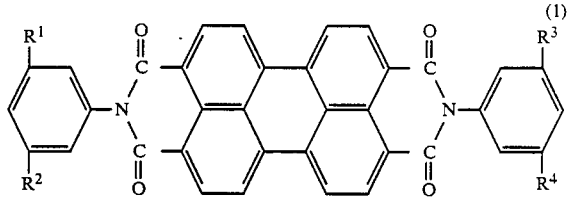

wherein $R^1$, $R^2$, $R^3$, and $R^4$ independently stand for an alkyl group of $C_1$ to $C_6$, and (2)

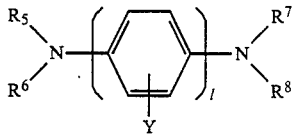

wherein $R^5$, $R^6$, $R^7$, and $R^8$ independently stand for a group of the following general formula:

(3)

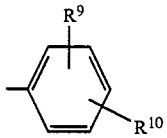

or (4)

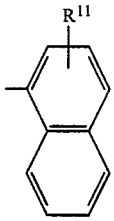

(wherein $R^9$, $R^{10}$, and $R^{11}$ independently stand for a member selected from the group consisting of a hydrogen atom, alkyl groups of $C_1$ to $C_6$, alkoxy groups of $C_1$ to $C_6$, and halogen atoms), providing that $R^5$, $R^6$, $R^7$, and $R^8$ each stand for either of the group (3) and the group (4) or $R^5$ and $R^7$ each stand for the group (3) and $R^6$ and $R^8$ each stand for the group (4); Y stands for one member selected from the group consisting of a hydrogen atom, alkyl groups of $C_1$ to $C_6$ alkoxy groups of $C_1$ to $C_6$, and halogen atoms; and l stands for an integer in the range of 1 to 3.

2. An electrophotographic sensitive material according to claim 1, wherein said $R^1$, $R^2$, $R^3$, and $R^4$ independently stand for alkyl group of $C_1$ to $C_4$.

3. An electrophotographic sensitive material according to claim 2, wherein said perylene compound is N,N'-bis(3,5-dimethylphenyl)perylene-3,4,9,10-tetracarboxydiimide.

4. An electrophotographic sensitive material according to claim 1, wherein said diamine derivative is represented by the following general formula (2-*a*).

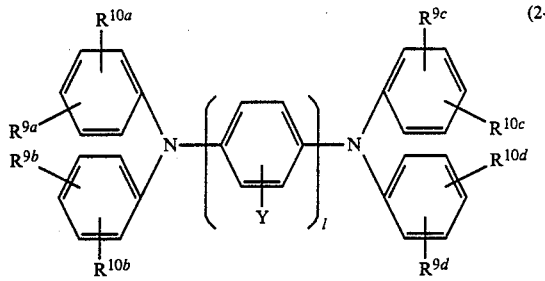

(2-a)

wherein $R^{9a}$ to $R^{9d}$ and $R^{10a}$ to $R^{10d}$ independently stand for a substituent selected from the group consisting of a hydrogen atom, alkyl groups of $C_1$ to $C_6$, alkoxy groups of $C_1$ to $C_6$, and halogen atoms, Y is selected from the group consisting of a hydrogen atom, alkyl groups of $C_1$ to $C_6$, alkoxy groups of $C_1$ to $C_6$, and halogen atoms, and l stands for an integer in the range of 1 to 3.

5. An electrophotographic sensitive material according to claim 4, wherein the number of carbon atoms in said alkyl group and that in said alkoxy group independently are an integer in the range of 1 to 4.

6. An electrophotographic sensitive material according to claim 1, wherein said diamine derivative is represented by the following general formula (2-*b*).

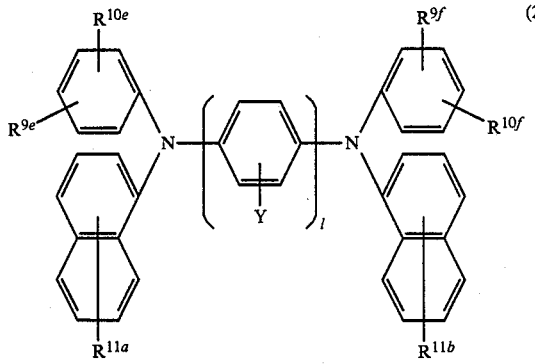

(2-b)

wherein $R^{9e}$, $R^{9f}$, $R^{10e}$, $R^{10f}$, $R^{11a}$, and $R^{11b}$ independently stand for one substituent selected from the group consisting of a hydrogen atom, alkyl groups of $C_1$ to $C_6$, alkoxy groups of $C_1$ to $C_6$, and halogen atoms, and Y is selected from the group consisting of a hydrogen atoms, alkyl groups of $C_1$ to $C_6$, alkoxy groups of $C_1$ to $C_6$, and halogen atoms, and l stands for an integer in the range of 1 to 3, providing that at least either of $R^{9e}$ and $R^{10e}$ stands for a hydrogen atom and at least either of $R^{9f}$ and $R^{10f}$ stands for a hydrogen atom.

7. An electrophotographic sensitive material according to claim 6, wherein the number of carbon atoms in said alkyl group and that in said alkoxy group independently are an integer in the range of 1 to 4.

8. An electrophotographic sensitive material according to claim 1, wherein said diamine derivative is represented by the following general formula (2-*c*).

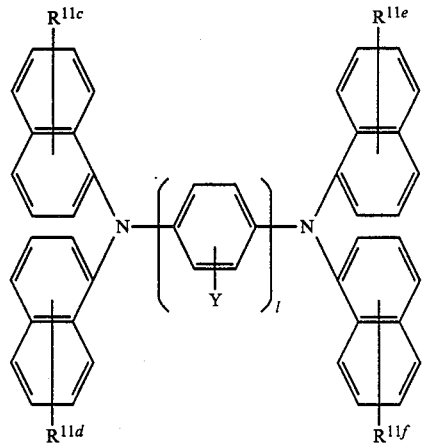

(2-c)

wherein $R^{11c}$ to $R^{11f}$ independently stand for one substituent selected from the group consisting of a hydrogen atom, alkyl groups of $C_1$ to $C_6$, alkoxy groups of $C_1$ to $C_6$, and halogen atoms, Y is selected from the group consisting of a hydrogen atom, alkyl groups of $C_1$ to $C_6$, alkoxy groups of $C_1$ to $C_6$, and halogen atoms, and l stands for an integer in the range of 1 to 3.

9. An electrophotograhic sensitive material according to claim 8, wherein the number of carbon atoms in said alkyl group and that in said alkoxy group independently are an integer in the range of 1 to 4.

10. An electrophotographic sensitive material according to claim 1, wherein said sensitive layer contains 2 to 20 parts by weight of said perylene type compound and 40 to 200 parts by weight of said diamine derivative, based on 100 parts by weight of said binding resin.

11. An electrophotographic sensitive material according to claim 10, wherein said sensitive layer contains metal-free phthalocyanine or titanyl phthalocyanine.

* * * * *